US005137217A

United States Patent [19]

Duncan

[11] Patent Number: 5,137,217

[45] Date of Patent: Aug. 11, 1992

[54] MICA DELIMINATOR

[75] Inventor: Donald H. Duncan, Spruce Pine, N.C.

[73] Assignee: J.M. Huber Corporation, Rumson, N.J.

[21] Appl. No.: 740,327

[22] Filed: Aug. 5, 1991

Related U.S. Application Data

[63] Continuation-in-part of Ser. No. 459,528, Jan. 2, 1990, Pat. No. 5,037,034.

[51] Int. Cl.[5] ..... B02C 19/12

[52] U.S. Cl. ..... 241/4; 241/21

[58] Field of Search ..... 241/4, 21, 23, 65, 248, 241/199.9, 202, 199.12, 246, 247, 186 A, 284, 278 R, 26

[56] References Cited

U.S. PATENT DOCUMENTS

| | | | |
|---|---|---|---|
| 1,829,039 | 10/1931 | Davenport | 241/4 |
| 2,547,336 | 4/1951 | McDaniel et al. | 241/4 |
| 2,614,055 | 10/1952 | Senarclens | 241/4 |
| 3,327,951 | 6/1967 | DuBose | 241/4 |

*Primary Examiner*—Mark Rosenbaum
*Assistant Examiner*—S. Thomas Hughes
*Attorney, Agent, or Firm*—Harold H. Flanders; Alec H. Horn; Robert L. Price

[57] ABSTRACT

A mica plate delaminator has a delaminating cylindrical chamber with a flat disk mounted on a drive shaft at a 65 degree angle to the shaft. A screw feeder feeds material from a hopper into the delaminating chamber and the disc is rotated at 600–1200 rpm to force the mica back and forth over itself and the clearance between the disc and the housing to a discharge, delaminating the mica plates to small flakes.

8 Claims, 3 Drawing Sheets

MICA DELIMINATOR

This is a continuation-in-part of my copending application Ser. No. 07/459,528 filed Jan. 2, 1990 and now U.S. Pat. No. 5,037,034, issued Aug. 6, 1991.

BACKGROUND OF THE INVENTION

This invention relates to the delaminating of mica "plates" into small "flakes" for use as additives in various industrial applications. As with most minerals, mica is mined and then processed into a form suitable for the intended use. Heretofore this generally has involved "cleaning" of the mined mica, preliminary crushing of the ore and then separating the usable product from contaminants, unusable fines, etc., by milling or other time and energy consuming processes. For instance, in some of the prior art, time of processing is described as many hours or even days. The difficulty, energy required, and costs involved have been great and the yield of suitable product low with prior devices and processes.

Patents showing various processes noted in a preliminary search include: U.S. Pat Nos. 3,416,740; 2,547,336; 3,432,030; 533,384; 2,999,649; 2,204,063; and British patent 1,222,508.

U.S. Pat. No. 3,416,740 to Hodgson appears to applicant to be the closest prior art. The impeller in the drawings of Hodgson is inclined at a much greater angle, has a number of holes in it, is fed by a pump, and specifies the use of a milling medium. The present invention uses no "medium", uses a fixed volume feed, has the impeller mounted at a much smaller angle to the drive shaft, ;uses a hexagonal delaminating chamber in one embodiment, and uses the heat of separation to produce steam for facilitating the process, all of which results in a more efficient and cost effective machine and process as will become apparent from the following detailed description.

The other patents cited show various older attempts to separate and refine clay, mica and Ti02 by involved processes requiring chemical treatment, high velocity agitation, and extensive grinding in aqueous solutions. The yield and power required to operate these systems have generally prevented them from becoming commercially successful.

The present invention permits continuous operation versus the batch operation of the prior art and also results in a reduction in horsepower and time required to produce a 250 time required to produce one pound of finished product.

SUMMARY OF THE INVENTION

It is therefore an object of the present invention to provide an apparatus and method wherein the difficulties of the prior devices and processes are reduced or eliminated.

It is another object of the present invention to provide an improved mica plate delaminator that is capable of greatly increased output at significantly reduced power requirements.

It is a further object of the present invention to provide an apparatus, for delaminating mica plates into small "flakes", of a simplified construction that is easy to operate and maintain and has a minimum number of interacting parts and controls.

These and other further objects of the present invention will become apparent from the following summary and detailed description.

The mica plate delaminator of the present invention consists of a cylindrical chamber fed from a screw conveyor, a shaft extending into the cylindrical delaminating chamber, a flat disk impeller mounted on the end of said shaft in the delaminating chamber, an input hopper disposed to feed material to be delaminated into said chamber, a cooling water jacket surrounding the delaminating chamber and a motor to rotate the shaft.

In operation a hopper is filled with mica material to be delaminated. This material is fed from the hopper via a screw feeder to the delaminating chamber. Water is added as necessary to permit efficient mixing and delamination.

The delaminating disc separates the mica into small flakes through a combination of compression, tumbling, sliding, and frictional action on the mica plates accentuated by the small sixty-five degree angle between the disc and shaft. The separate small flakes are discharged from the device through an appropriate opening in the outboard face of the delaminating chamber.

During the delaminating process a large amount of heat is generated which results in a temperature in the delaminating chamber of at least two hundred forty degrees Fahrenheit. This heat turns at least a portion of the water in the mixture being fed into the device into steam, which facilitates and enhances the delaminating of the mica plates during the above mentioned physical torturing of the mica plates. Cooling water is circulated through a jacket surrounding the delaminating chamber as required to maintain the desired temperature.

DETAILED DESCRIPTION OF THE PREFERRED EMBODIMENT

Figure 1:
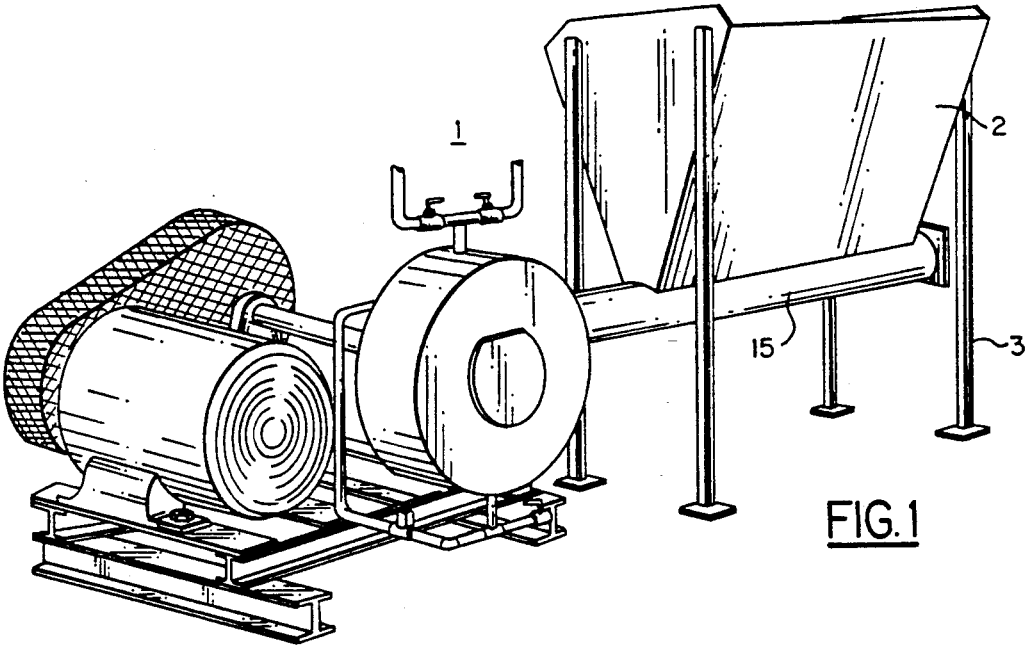
FIG. 1 is a perspective view of one embodiment of this invention.
Figure 2:
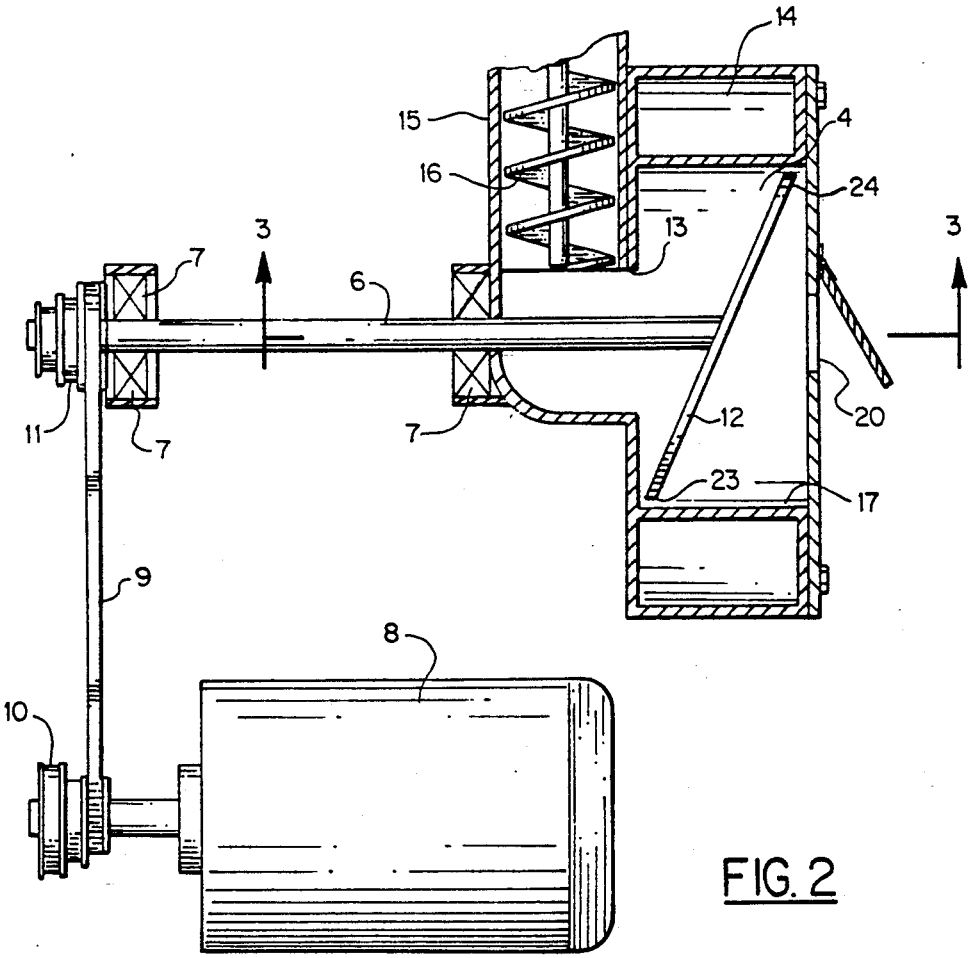
FIG. 2 is a partial horizontal view of the device of FIG. 1 with the housing shown in section.
Figure 3:
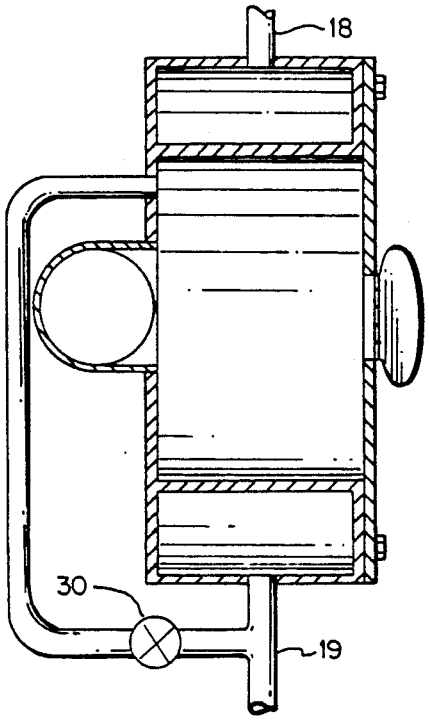
FIG. 3 is a sectional view on line 3—3 of FIG. 2.

Referring now to FIGS. 1-3, the delaminator 1 consists of a hopper 2, mounted on legs 3 to elevate the bottom of the hopper to proper elevation to feed material into the delaminating chamber 4, via feeder 15 and feeder screw 16, drive shaft 6, mounted in bearings 7, (shown schematically) and driving motor 8 arranged to drive shaft 6 through belt 9 and pulleys 10 and 11. Shaft 6 extends into delaminating chamber 4 and has delaminating disc 12 mounted thereon. Disc 12, in one embodiment, is mounted on the end of shaft 6 at an angle of sixty-five degrees to the axis of shaft 6.

Conveyor screw 16 feeds material from hopper 2 through opening 13 into delaminating chamber 4. Delaminating chamber 4 is surrounded by a water cooling jacket 14 to allow the temperature in the chamber to be maintained at the desired temperature. Suitable cooling fluid—normally water, may be introduced through pipe 18 and discharged through pipe 19 (FIG. 3). Preferably a portion of the warm water from pipe 19 is used as make up water for the mixture in delaminating chamber 4. Water is added to allow uniform and continuous mixing of the mica introduced from hopper 2. If the mixture is too dry, the power required increases and improper mixing occurs. Normally addition of water is controlled by solenoid valve 30 which is actuated when the current drawn by motor 8 exceeds a preset level. The delaminating chamber 4, shaft 6, and drive motor 8 are mounted a suitable frame and with legs 3 on the hopper adjusted to permit feeding of material from the hopper through screw feeder 15 through opening 13 into the chamber 4.

The screw 16 within feeder 15 is driven by any convenient means such as a motor, not shown. The diameter, pitch and rpm of screw 16 are chosen to maintain the input side of chamber 4 full at all times so as to provide a fixed volume of fed material to chamber 4 and maintain a predetermined feed pressure on the material to be delaminated. It has been found that having the feeder smaller in diameter than the delaminator chamber 4 facilitates the pressure build-up and improves the delaminating action.

Figure 7:
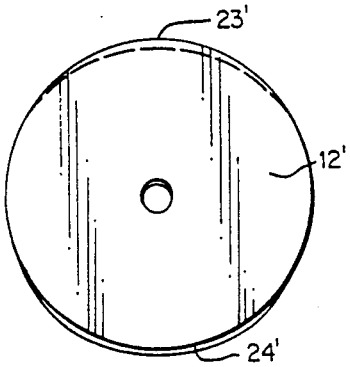
FIG. 7 is a plan view of the delaminating disc.

As may be seen in FIGS. 2 and 7, the delaminating disc edges 23–24 are tapered at diametrically opposed segments of approximately thirty degrees so as to conform to the inner surface of the outer shell of the delaminating chamber 4 during revolution. The angle of taper of these edges 23 and 24 varies from sixty-five degrees (as the delaminating disc 12 is mounted relative to the shaft 6) at a first diameter, to zero at a diameter displaced ninety degrees from the first diameter. This results in a constant clearance of the desired magnitude between the disc edge and housing of chamber 4 as disc 12 is rotated. The clearance between disc 12 and housing 17 is chosen along with the feed pressure and material viscosity to give the desired final mica flake size consistent with the desired speed of operation and product yield. In one embodiment, a clearance of one-half inch has been found satisfactory.

The clearance for screw 16 is chosen for easy operation and feeding of the material to be delaminated from the hopper to chamber 4.

This fixed feed volume and pressure forces the mica "plates" over each other and the edge of the disc 12 during the rotation of disc 12 causing them to be delaminated by a combination of bending, frictional sliding, rotation, and compression between individual particles of material, and between the particles of material and disc 12, and the chamber housing 7. This results in the plates of mica being delaminated into the desired small flakes rather than being ground or milled into a powder.

As the mica plates are delaminated, a significant amount of heat is generated. Much of the heat must be removed by cooling fluid in the cooling jacket, but some of this heat is used to turn the water content of the material to be delaminated into steam. The initial water content of the mica material is adjusted for efficient mixing and maintained at this level by the control described above. The temperature in the delaminating chamber is held at two hundred forty degrees Fahrenheit by the cooling water in jacket 14. This results in some of the water being turned into steam which facilitates the separation of the layers of the mica plates and also lubricates the movement of the particles, one against the other.

The process of the present invention starts with the introduction of the mica material to be delaminated into hopper 2. The mica employed in tests and processes described is commonly referred to as a free splitting muscovite. This has a bulk-density of approximately thirty pounds per cubic foot in the dry state. The usual mix contains widely varying particles from fines to approximately three inches across. This material is further prepared for delamination by adding water in chamber 4 until a mixture of approximately sixty to seventy percent (60–70%) solids in the delaminating chamber is obtained.

The dry mixture is fed from the hopper 2 via feeder 15 to the chamber 4. As indicated previously, the feeder screw 16 is sized and operated to feed material into the delaminating chamber 4 at a positive, fixed volume and pressure. This keeps the first half of delaminating chamber 4 full at all times. During one revolution, delaminating disc 12 is forced from the position shown in FIG. 1 to the exact reverse and back again. In effect, disc 12 oscillates back and forth through the material in chamber 4 about the end of the shaft 6 forcing some of the material vertically downwardly through other material and some material over the edges of disc 12 through the one-half inch clearance mentioned above.

The delaminator disc 12 is rotated at a speed sufficient to produce the desired mica delamination and particle size within the limits of the set clearance and angle of the disc 12. In a preferred embodiment, speeds of 600 to 1200 RPM have been used with the clearance shown at 38 in FIG. 4, preferably in the range of one-half inch. It has been found that the material on average, resides in chamber 4 from twenty-four minutes to twelve minutes, depending on the RPM of disc 12.

The delaminated mica particles are discharged through exit opening 20 in the outer wall of the delaminator chamber 4 and collected in any suitable container. The mica particles discharged from exit 20 have very little moisture associated with them and are ready for further processing.

The discharge opening 20 is shown as being concentric with shaft 6 and approximately one-and-one-half inches to three inches in diameter where the delaminator chamber is approximately twenty four inches in inside diameter. The right side of chamber 4 in FIG. 2 thus is maintained approximately one-half full. A hinged cover 21 is provided to close exit 20 when material is not being discharged.

Figure 9:
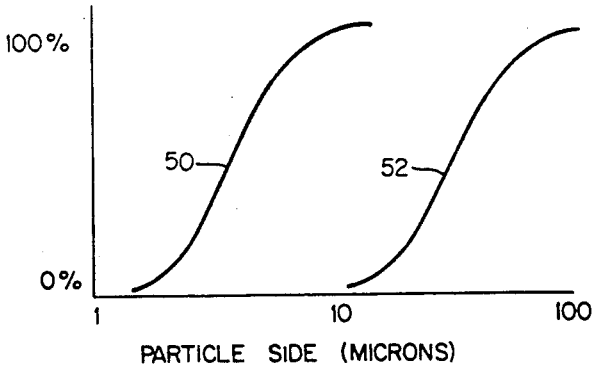
FIG. 9 shows the particle size distribution for the crude and finished product.

Delamination, once the apparatus achieves operating speed and temperature, appears to produce a delaminated mica flake product of sixty-five percent to forty-nine percent solids of three-hundred-twenty-five mesh at a rate of approximately 700 to 1400 pounds per hour. The yield will vary depending on the rate of feeding and the RPM of the disc 12. The resulting bulk-density of the product is approximately eight pounds per cubic foot as compared to standard mulled product, bulk density of twelve pounds per cubic foot. Typical particle size distribution curves are shown in FIG. 9 for the crude ore and finished product. Curve 52 represents the crude ore size distribution and curve 50 represents the delaminated particle size distribution.

The lighter bulk-density of the finished product of the present invention results in a superior "mica flake" product which produces comparable results to milled and ground products when used as a filler in paints, plastics and the like.

With the foregoing apparatus, it has been found that the electricity required to process a pound of mica plates is greatly reduced. In the embodiment shown, an electric motor of seventy-five horsepower has been found to be adequate to produce 700–1400 pounds per hour of delaminated mica flakes. This is approximately forty to fifty percent of the size of prior art motors used to produce this quantity of delaminated material.

Figure 4:
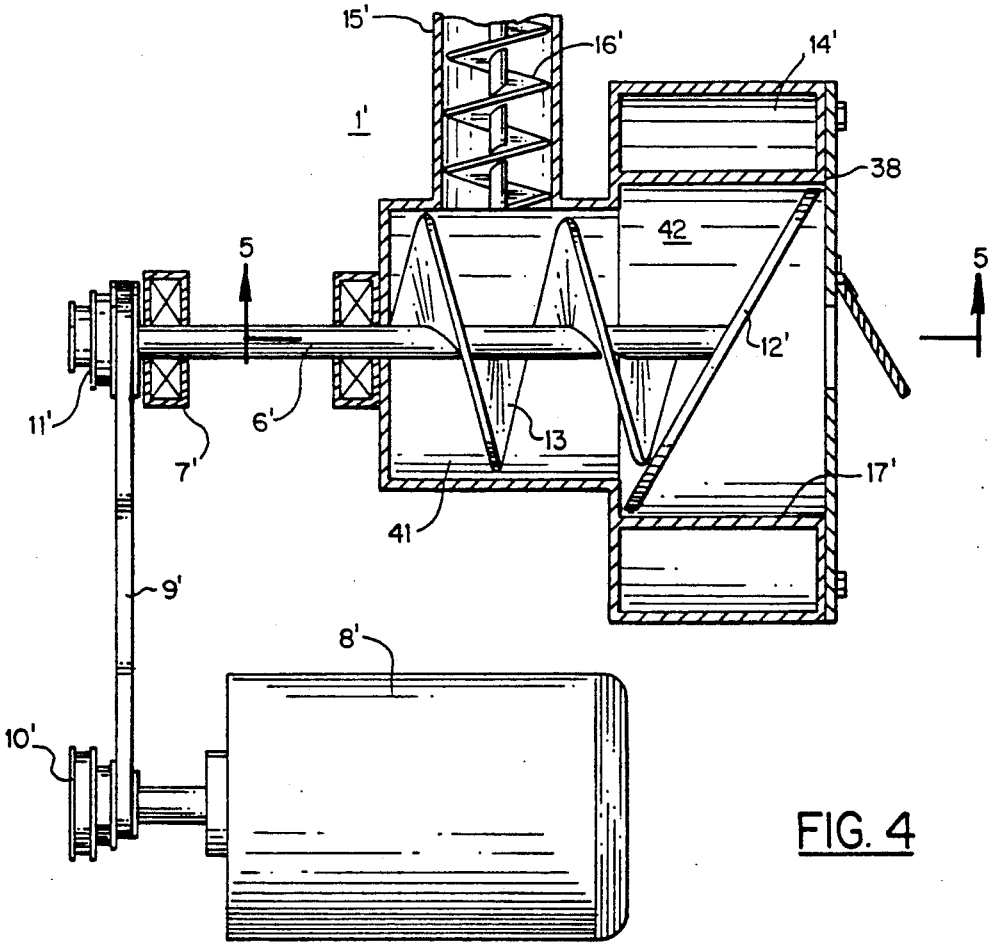
FIG. 4 is a view similar to FIG. 2 of another embodiment of the invention.
Figure 6:
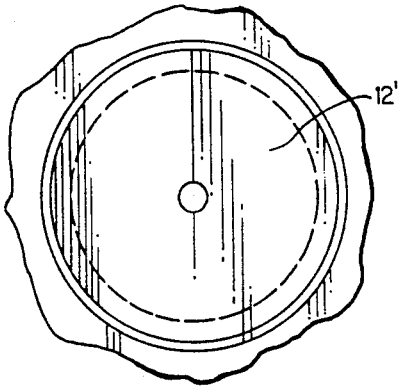
FIG. 6 is a sectional view on line 6—6 of FIG. 5.
Figure 5:
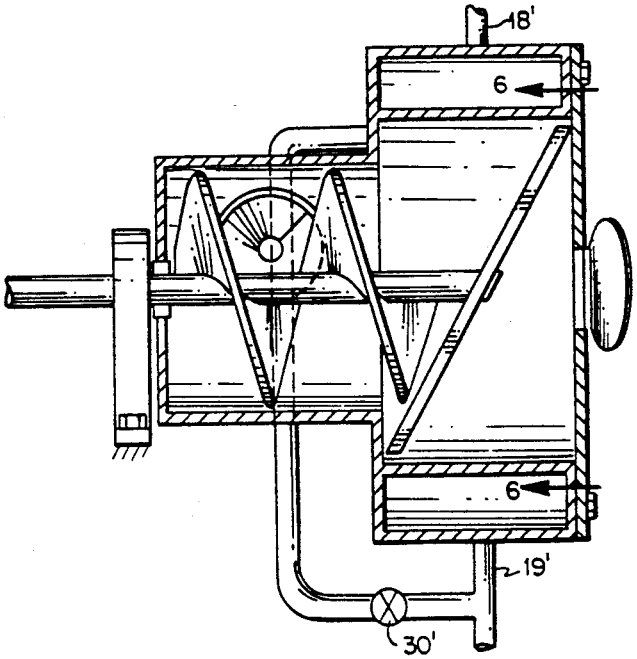
FIG. 5 is a sectional view on line 5—5 of FIG. 4.

Referring now to FIGS. 4–6, the delaminator 1' consists of a hopper (not shown), and screw feeder 16' to feed material into the delaminator feeder chamber 41, a delaminating chamber 42, drive shaft 6' mounted in bearings 7', (shown schematically) and driving motor 8' arranged to drive shaft 6' through belt 9' and pulleys 10' and 11'. Shaft 6' extends through feeder chamber 41 into delaminating chamber 42 and has delaminating disc 12 mounted on the end thereof. Disc 12', in one embodiment, is mounted on the end of shaft 6' at an angle of sixty-five degrees to the axis of shaft 6'. Screw feeder 13 in chamber 41 is also mounted on shaft 6'.

Feeder chamber 41 receives mica from conveyor screw 16' and directs it into delaminating chamber 42. Delaminating chamber 42' is surrounded by a water cooling jacket 14' to allow the temperature in the chamber to be cooled to the desired point. Suitable cooling fluid—normally water, may be introduced through pipes (not shown) for this purpose. Preferably, a portion of the warm water discharged from jacket 14' is used as make up water for the mixture in the delaminating chamber. Water is added to allow uniform and continuous mixing of the mica introduced from hopper as in the prior embodiments. Material from the hopper is fed through screw feeder 15' into the delaminator feeder chamber 41 at a point above the center line of screw 13. The material is introduced into feeder chamber 41 in the feed direction of screw 13 as shown more clearly in FIG. 5.

The screw 16' within feeder 15' is driven by any convenient means such as a motor, not shown. The diameter, pitch and rpm of screw 16' are chosen to maintain feeder chamber 41 full at all times so as to provide a fixed volume of material to be delaminated for chamber 42. It has been found that having the feeder smaller in diameter than the delaminator chamber facilitates the pressure build-up and improves the delaminating action. The moisture at 16 is preferably approximately 3–4% lower than the moisture in the grinding chamber.

As may be seen in FIGS. 4 and 7 the delaminating disc edges 23'–24' are tapered as shown in the earlier embodiments. The clearance between disc 12' and housing 17' is chosen along with the feed pressure to give the desired final mica flake size consistent with the desired speed of operation and product yield. In one embodiment, a clearance of one-half inch has been found satisfactory.

This fixed feed volume and pressure forces the mica "plates" over the edge of the disc 12' during the rotation of disc 12' causing them to be delaminated by a combination of bending, frictional sliding, milling, and compression between the particles of material, disc 12', and the chamber 42 housing. This results in the plates of mica being delaminated into the desired small flakes rather than powdered.

Figure 8:
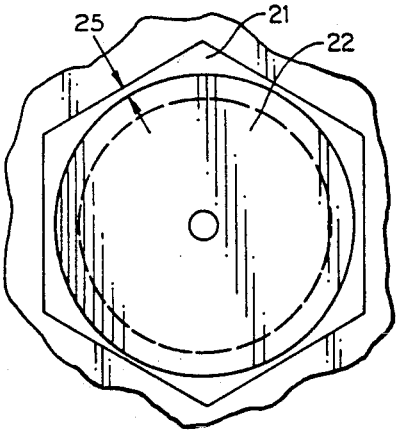
FIG. 8 is a view similar to FIG. 6 of another embodiment of the present invention.

Referring now to FIG. 8, there is shown another embodiment of the present invention wherein the delaminating chamber 21 has a hexagonal cross section rather than round. The delaminating disc 22 is circular and chosen with a diameter such that the clearance at the "tangent" point of the sides of the hexagonal chamber is one-half inch as indicated at arrows 25.

In this embodiment, it has been found that for certain types of mica mixtures and desired final particle sizes, the larger apertures at the hexagonal corners permit a "fold over" of the mix resulting in a greater yield of end product for the same power input.

As one skilled in the art will readily appreciate the present invention may be employed as a mixer, a blender, a muller, a grinder, a juicer and a delaminator by its effective action of compression causing a centrifugal, peripheral extrusion of the mixture within.

The ease of access (and of cleaning) make the present invention of particular interest for such uses in the food industry.

The continuous economical mixing at rates on the order of one ton per hour with a 50 hp. motor operating at 460 volts 60 amps suggests many uses such as for example the mixing of drilling muds, chemicals, and the like.

While this invention has been explained with reference to the structure disclosed herein, it is not confined to the details as set forth and this application is intended to cover any modifications and changes as may come within the scope of the following claims.

What is claimed is:

1. A process for delaminating mica plate material into finely divided mica flakes which comprises;

introducing a plastic mixture of mica plate material into a feeder zone;

positively feeding from said feeder zone a predetermined volume of said mica plate material into a delaminating zone, so as to maintain a positive feeding pressure in said delaminating zone;

introducing water to said mica plate material in said delaminating zone to maintain a solids ratio in the range of 60–70%;

subjecting said mica plate material in said delaminating zone only to compression, shearing, bending, and plate to plate friction forces so that said mica plate material is delaminated into flakes without producing substantial amounts of powdered mica; and discharging the flake material from said delaminating zone.

2. The process according to claim 1 wherein subjecting said mica plate material to compression, shearing, bending and plate to plate friction forces comprises pivoting a solid plate about a horizontal axis at the midpoint thereof, oscillating said plate back and forth through said plastic mixture in a confined chamber within said delaminating zone over an angle of at least plus or minus 30° from a middle position.

3. The process according to claim 1 further including maintaining the moisture content of said mica plate material in said feeder zone between approximately three and four percent lower than the moisture content of said mica plate material in said delaminating zone.

4. The process of claim 1 wherein said mica plate material in said delamination zone is forced back and forth through a restricted aperture within said zone to rub mica plate against mica plate to compress, shear and bend said mica plates until delaminated.

5. The process of claim 4 further defined by controlling the temperature of said mica plate material in the delaminating zone at a level high enough to turn the water content into steam; and causing the steam to combine with the physical forces in the delaminating zone to cause the mica plate material to separate into small flakes.

6. The process according to claim 5 in which cooling water is added to said delaminating zone to maintain the temperature of the mica plate material at 240° F.

7. The process according to claim 6 further defined by controlling said rate of feeding of said mica plate material from the feeder zone into the delaminating zone to produce an output from said delaminating zone of 65% solids of 325 mesh size.

8. A process for delaminating mica plate material into finely divided mica flakes without producing powdered mica which comprises;

introducing a plastic mixture of mica plate material into a feeder zone;

positively feeding from said feeder zone a predetermined volume of said mica plate material into a delaminating zone, so as to maintain a positive feeding pressure in said delaminating zone;

maintaining the moisture content of said mica plate material in said feeder zone between approximately three and four percent lower than the moisture content of said mica plate material in said delaminating zone;

oscillating a solid plate back and forth through said plastic mixture within said delaminating zone over an angle of at least 60° to subject said mica plate material in said delaminating zone to compression, shearing, bending, and plate to plate friction forces only so that said mica plate material is delaminated into flakes and not ground to a power; and discharging the flake material from said delaminating zone.

* * * * *